United States Patent [19]

Klancnik et al.

[11] Patent Number: 5,039,074

[45] Date of Patent: Aug. 13, 1991

[54] MACHINE TOOL FIXTURE

[76] Inventors: Adolph V. Klancnik, 1020 Glenview Rd., Glenview, Ill. 60025; Kenneth A. Klancnik, 527 Brighton La., Palatine, Ill. 60067

[21] Appl. No.: 640,124

[22] Filed: Jan. 11, 1991

[51] Int. Cl.[5] ..... B66C 1/02

[52] U.S. Cl. ..... 269/34; 269/234; 269/268

[58] Field of Search ..... 269/34, 26, 234, 268

[56] References Cited

U.S. PATENT DOCUMENTS

| | | | |
|---|---|---|---|
| 2,850,926 | 9/1958 | Jobe | 269/34 |
| 3,170,322 | 2/1965 | Cavanaugh | 269/234 |
| 4,362,261 | 12/1982 | Cook | 269/34 |
| 4,537,389 | 8/1985 | Kancnik et al. | 269/34 |
| 4,858,901 | 8/1989 | Okugama et al. | 269/34 |
| 4,901,991 | 2/1990 | Bonkowski | 269/234 |

*Primary Examiner*—Robert C. Watson

*Attorney, Agent, or Firm*—Kinzer, Plyer, Dorn, McEachran & Jambor

[57] ABSTRACT

Machine tool fixture for clamping a workpiece characterized by jaw members nested in an overlapped relation with jaw closing cam surfaces in laterally spaced relation defining a slot in which is positioned a complemental cam section of a cam plunger moving on an axis normal to the axis of jaw movement. In one embodiment the plunger and jaws have a second set of complemental cam surfaces to open the jaws; in a second embodiment, springs are used to open the jaws at a corresponding limit position of the cam plunger.

5 Claims, 4 Drawing Sheets

MACHINE TOOL FIXTURE

INTRODUCTION

This invention relates to a machine tool fixture characterized by a pair of reciprocal jaws adapted to open and close, enabling a finished workpiece to be inserted into the jaw cavity in the open position and closed thereon to clamp the workpiece so that it may be drilled, tapped, turned, countersunk or otherwise worked.

BACKGROUND AND OBJECTIVE OF THE INVENTION

Fixtures of the kind described above are generally known. Indeed, U.S. Pat. Nos. 4,537,389, 4,637,524 and 4,645,092 of the present assignee are examples.

The primary objects of the present invention are to construct the jaws for reciprocal opening and closing motion, closing motion in particular being effected by a strong cam action exerted by a cam plunger reciprocal along an axis normal to jaw motion, avoiding stressing of guides which capture the jaw members, and to so construct the jaws that they are overlapped in a compact nesting relation which further assures accurate straight line motion and centering of the cam plunger midway between spaced complemental cam surfaces of the jaw members. Another object is to develop construction of the jaw members an cam plunger by which either a horizontal or vertical feed of the workpiece may be accommodated.

SUMMARY OF THE INVENTION

The jaw members are nested in an overlapped relation with jaw closing cam surfaces in laterally spaced relation defining a slot in which is positioned a complemental cam section of a cam plunger moving on an axis normal to the axis of jaw movement. Guides or retainers assure acurate lateral movement of the jaw members, but the guides are unstressed when the strong clamping or jaw closing force of the plunger is applied. In one embodiment the plunger and jaws have a second set of complemental cam surfaces to open the jaws; in a second embodiment, springs are used to open the jaws at a corresponding limit position of the cam plunger.

SUMMARY DESCRIPTION

Because parts of the present fixture are overlapped like a handshake, because mirror image cam surfaces are involved and because the master jaws are in reality an assembly of parts moving in unison, the detailed description hereinafter set forth can be better understood by the schematic showing, FIG. 8.

The fixture includes a pair of left and right L-shaped master jaws 10L and 12R. In FIG. 8 these jaws are separated but in the actual construction, the embodiment of FIGS. 1 and 2, they overlap in a handshake or clasp relation.

Figure 8:
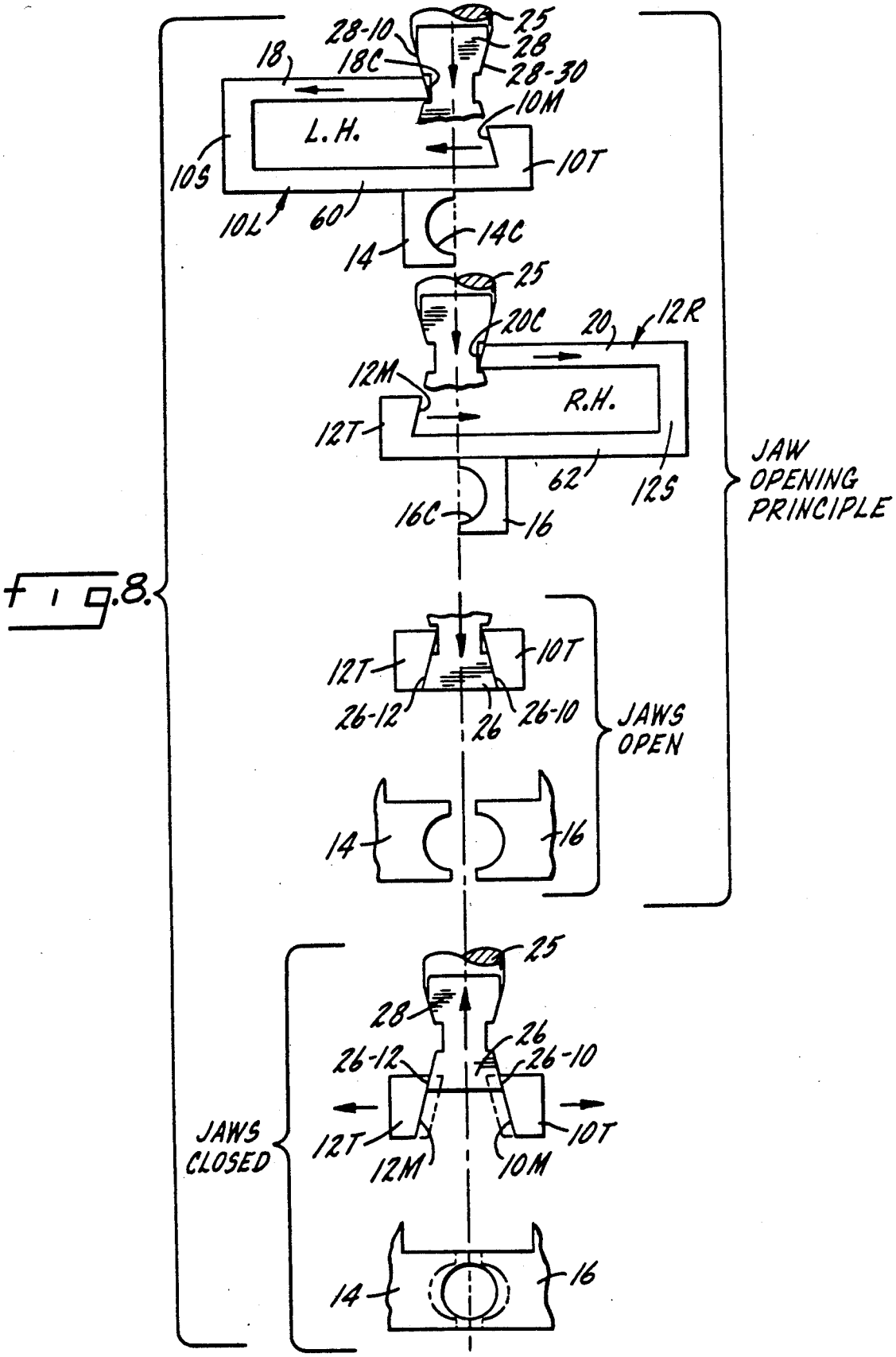
FIG. 8 is a schematic aid.

The master jaws are U-shaped as can be seen in FIG. 8, and each supports a slave jaw 14 and 16 respectively. The slave jaws in the assembly are opposed to one another, FIGS. 2 and 4, and are notched at the adjacent surfaces (14C, 16C) to clamp the workpiece (not shown) between them. The slave jaws are detachable so that differently configured workpieces may be accommodated by the fixture.

The master jaws are mirror images of one another and each embodies two important cam surfaces. Jaw member 10L has a cam tooth 10T at one end and jaw member 12R has a cam tooth 12T at one end. These teeth respectively present sloped cam surfaces 10M and 12M at their inner sides.

The master jaws include left and right cam bars 18 and 20, respectively. Each cam bar has a free end presenting a cam surface 18C and 20C respectively. The opposite end of each cam bar is joined to a short transverse leg 10S, 12S, completing the generally U-shaped configuration for each master jaw.

Figure 2:
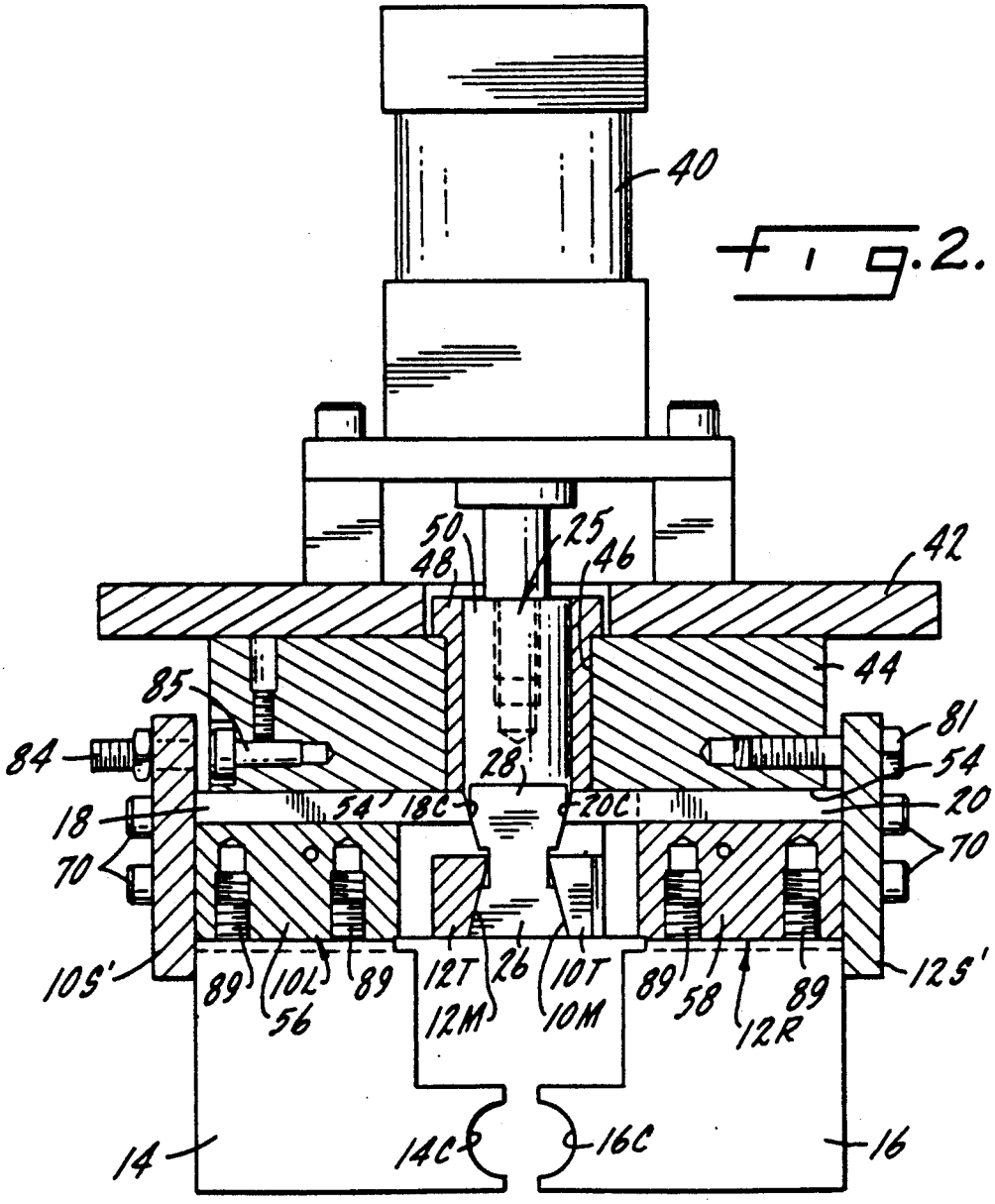
FIG. 2 is a section on line 2—2 of FIG. 1 with the slave jaws added, showing the clamp or cam in an advanced or jaw open position.
Figure 4:
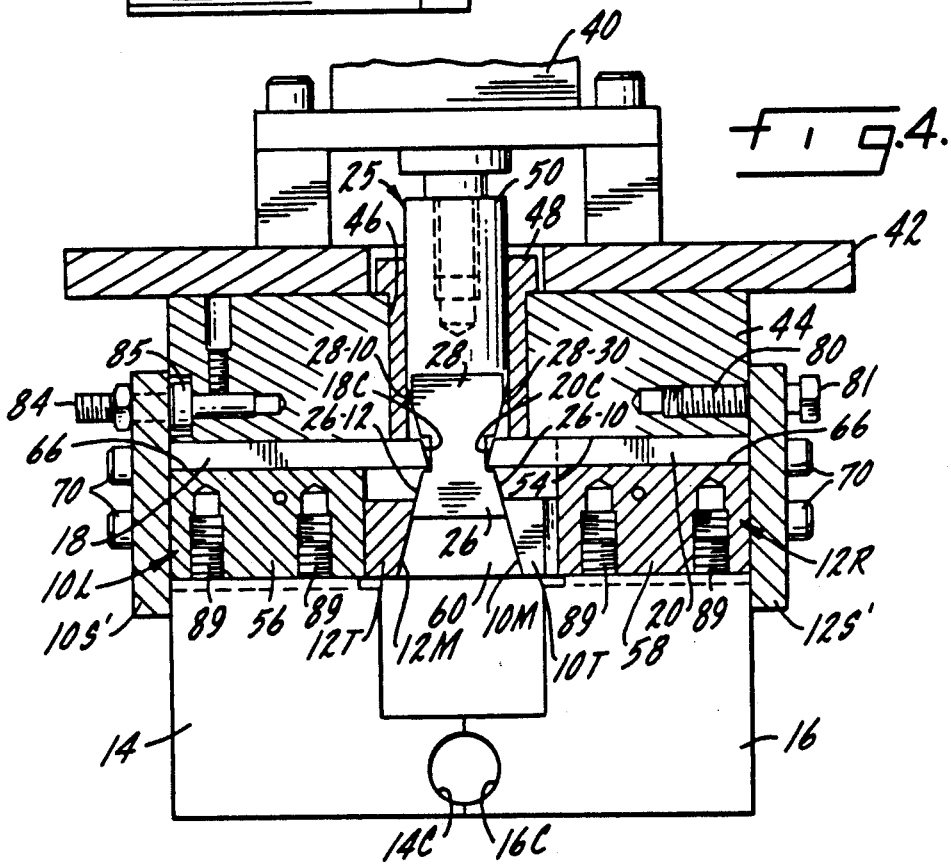
FIG. 4 is a section like FIG. 2 showing the piston in a restricted or jaw closing position.
Figure 5:
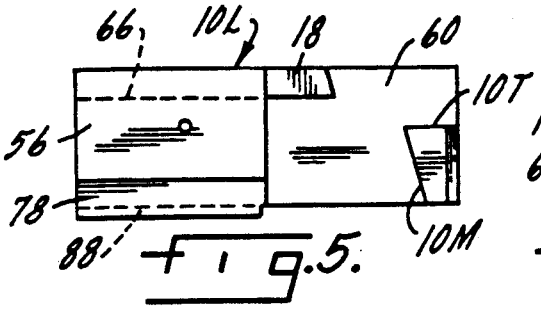
FIG. 5 is a top view of one of the master jaw members.

In the assembly the master jaws overlap, one atop another so to speak. When overlapped and nested in a holder (to be described) the teeth 10T and 12T are laterally spaced to define a slot between them as can be seen in FIGS. 2, 4 and 8. A reciprocal cam plunger or piston 25, FIG. 4, is disposed in the slot for reciprocal movement along an axis normal to lateral movement of the jaws.

The cam plunger 25 at one end has an extension 26 disposed between the teeth 10T and 12T of the master jaws. The extension 26 has opposite cam surfaces 26-10 and 26-12 engageable in a wedging relation with the cam surfaces 10M and 12M of the master jaws.

It can be readily visualized from FIG. 8 that when the cam plunger extension is retracted to one limit position (upward as viewed in FIG. 8) the jaw teeth 10T and 12T are spread apart by the cam plunger extension 26. Though the teeth 10T and 12T are thus spread apart outwardly of the slot (center line, FIG. 8), this results in the two master jaws moving inward toward the center line, FIG. 8, and the slave jaws 14–16 are closed.

Thus, it is important to bear in mind that when the cam plunger 25 is moved in one direction toward a limit position, the cam teeth 10T and 12T are spread outwardly, but the slave jaws close inwardly, concurrently; vice versa as will now be described, again by reference to FIG. 8.

The plunger 25 has an intermediate section 28, FIG. 8, presenting opposite cam surfaces 28-10 and 28-30 opposed to and in complemental relation to the cam surfaces 18C and 20C of the cam bars which are parts of the related master jaws. When section 28 of the cam plunger is advanced toward a second limit position (downward as viewed in FIG. 8), the cam bars are spread outward, to the left and right respectively. Thus, the cam bars 18 and 20 are actuated to shift the two master jaws, and cam teeth 10T and 12T are moved inwardly to an idle or inactive position at this time. The slave jaws open to release the workpiece

DETAILED DESCRIPTION

The cam plunger 25 is a reciprocal fluid-operated piston, the piston head (not shown) being housed in cylinder assembly 40, FIG. 2, secured to a mounting plate 42 which in turn is secured to the holder member 44 of the fixture.

The holder member has a large, transverse medial passage or opening 46 extended therethrough, lined with a guide bushing 48 which receives the driving head 50 of the plunger 25. The plunger 25 is configured at its free or outer end with the first or jaw closing cam section (extension 26) and rearwardly thereof presents the second or jaw opening cam section 28. These cam sections of course move back and forth with the plunger, and in doing so actuate the master jaws 10L and 10R.

Figure 3:
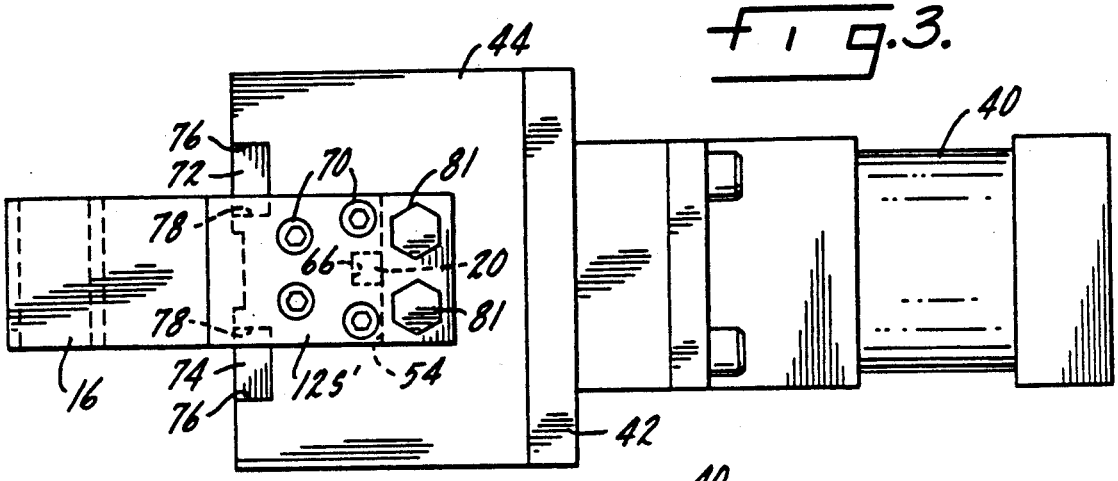
FIG. 3 is a side elevation of FIG. 1.

The master jaws 10L and 12R are captured in and guided by the holder member 44. To this end, the jaw holder member 44, FIG. 3, is formed with a large guide slot 54, and the two master jaw members are nested therein for confined, accurately guided movement. The left hand jaw 10L, FIG. 1, has a rectangular body section 56 neatly fitting the guide slot or bore 54, and the right hand jaw has a body section 58 in like configuration. The left hand jaw body 56 has a lip 60 projecting therefrom parallel to the axis of the body member bore 54; the right hand jaw body is likewise configured with a lip 62*n*.

Figure 1:
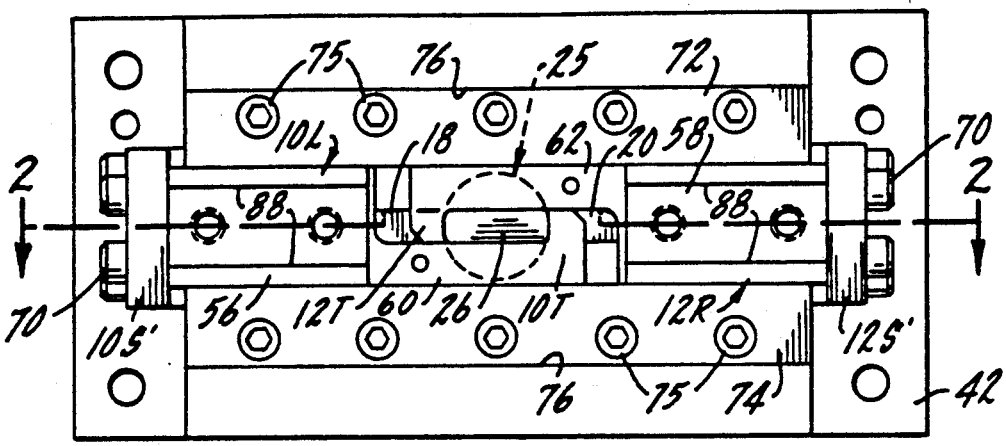
FIG. 1 is a front elevation of the fixture of the present invention with the slave jaws for the workpiece removed.

Each of the jaw lips 60 and 62 present, respectively, the cam teeth 10T and 12T and the nesting is such that the lips 60–62 overlap in spaced relation with the cam teeth in a handshake or clasp attitude, although the two cam teeth are spaced apart, FIGS. 1 and 2, so that the spaced cam surfaces 10M and 12M define a slot for receiving the free end of the cam plunger which has complemental cam surfaces 26–10 and 26–12 engageable with the cam surfaces 10M and 12M in a wedging relation.

Each master jaw has a squared elongated slot 66 in the rear surface, FIG. 3, and the respective cam bars 18 and 20 are fitted therein.

As noted above in connection with FIG. 8, each master jaw has a short side leg, schematically, 10S and 12S. In the preferred construction, these legs are separate plate-like members 10S' and 12S', FIG. 2, secured by screws 70 to the outer face of each jaw body member. As can be seen in FIG. 2, the outer ends of the cam bars 18 and 20 bear against the inner faces of the jaw member legs 10S' and 12S'. These side legs in effect join the cam bars and lips of the jaw members.

The master jaw assemblies are held against displacement, outward of the guide slot 54 by keeper plates 72 and 74, upper and lower as viewed in FIG. 1. The keeper plates are secured by screws 75 to the holder member 44, the latter having slots 76, FIG. 3, which capture the keepers so that there is considerable rigidity and securement. Additionally, the body sections 56 and 58 are slotted longitudinally as at 78, FIG. 3 to receive the opposed surfaces of the keepers 72 and 74, whereby the master jaws 10L and 12R are firmly and accurately guided.

The jaw members 10L and 10R when thus mounted and nested, one over the other, are centered to a common plane.

There are adjustable stops to limit the outward movement of the master jaw members. Referring first to FIG. 4, an adjustable screw 80, having a head 81, is secured to one side of the holder 44. FIG. 4 shows the slave jaws in the closed position. Leg 12S' of jaw member 12 has an opening therein which receives screw 80. There is a sight displacement between the screw head 81 and plate 12S', limiting outward movement of slave jaw 16 to its open position, FIG. 2. An adjustable set screw 84, mounted in the left-hand jaw leg 10S', opposed to a button 85 seated in holder 44, may also be used to set a limit on the inward movement of the jaw members.

Figure 6:
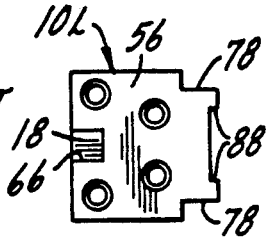
FIG. 6 is an end view of FIG. 5 as viewed from the left.
Figure 7:
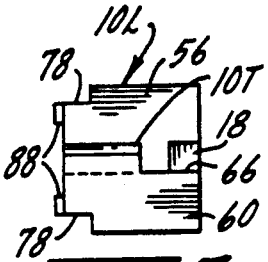
FIG. 7 is an end view of FIG. 5 a viewed from the right.

As shown in FIGS. 6 and 7, the master jaws at the outside face are notched, 88, to receive the slave jaws, secured therein by screws 89, FIG. 4.

OPERATION

The jaws are open, FIG. 2, and the jaw cavities 14C and 16C ready to receive the workpiece which incidentally, in actual practice, will be advanced and fed between the jaws automatically. Indeed, the fixture of the present invention may be one of many spaced circumferentially around a large turret, indexable to move the fixtures one after another to the workpiece loading station.

The jaws, FIG. 2, are in their open position as a result of the cam plunger being in its advanced limit position, the cam surfaces 28-10 and 28-30 having forced the cam bars 18-20 outwardly. The intermediate legs 10S' and 12S' of the master jaws are accurately spaced by stop 81.

In cyclically timed relation to automatic positioning of the workpiece between the open jaws, the cylinder 40 is valved so that the cam plunger 25 is retracted instantly by fluid pressure. The cam section 28 of the cam plunger is in idle motion during retraction, but cam section 26, being retracted, now comes into play: cam surfaces 26-10 and 26-12, FIG. 4, in their retracted position close the slave jaws tightly on the workpiece. This is a forceful action, but no moments are exerted on the keeper plates 72 and 74.

The master jaws are an assembly of three components which is of considerable help in fitting the master jaws n the holder body 44. For example, by employing the separable cam bars to present the opposed jaw opening cam surfaces 18C and 20C, the cam plunger can be extracted, FIG. 4, simply by removing the plates 10S' and 12S', allowing the cam bars to be removed from their slots.

Furthermore, the concentration is such that the closing thrust of the cam plunger is absorbed by the massive holder 44 and no strain is placed on the retainer or keeper plates 72 and 74 as noted.

SECOND EMBODIMENT

Figure 9:
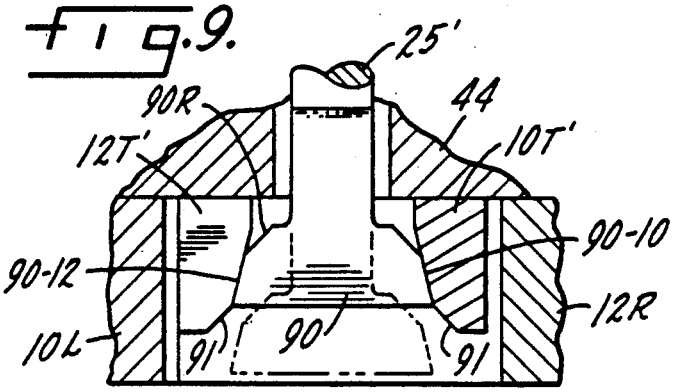
FIGS. 9, 9A and 9B are detail views of a second embodiment of the invention.
Figure 9B:
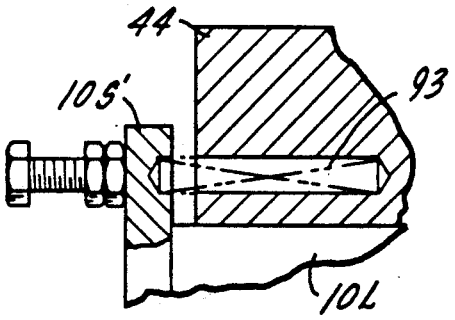

The foregoing addresses the situation where the workpiece is fed horizontally into the jaw-receiving cavity 14C–16C as viewed in FIG. 2. If the workpiece is to be dropped vertically, the slave jaws need to be opened to a considerably greater extent, and this involves a modified version of the foregoing, FIGS. 9, 9A and 9B. Referring in this regard to FIG. 9, the cam plunger is modified, 25', to have but a single cam section 90 at its free end, presenting cam surfaces 90-10 and 90-12 engageable with and complemental to the jaw closing cam surfaces of the cam teeth 10T' and 12T'. This is the retracted or jaw closing position of the plunger 25', in the jaw closure mode described above.

The jaw open or advanced position of the plunger 25' is shown by dashed line in FIG. 9 where the plunger is so far advanced as to be displaced beyond the cam teeth 10T' and 12T'; hence the related master jaw members 10L and 12R are free to move toward one another which, it will be recalled, actually spread or open slave jaws. To allow ample spreading or opening of the jaw members, the cam teeth are relieved at the free ends, 91, and the cam plunger is likewise relieved at 90R, behind the cam section 90.

Figure 9A:
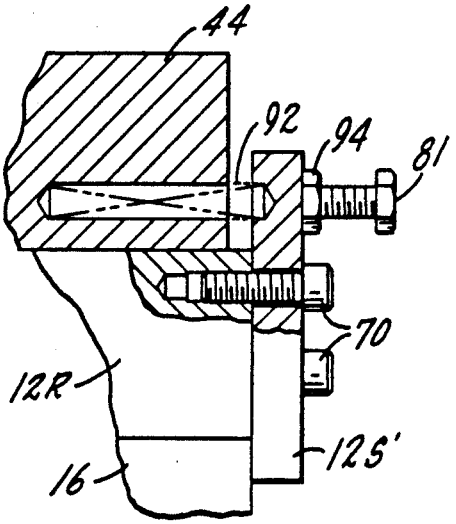

The jaw opening movement is accomplished by a pair of compression springs including a strong right-hand jaw spring 92, FIG. 9A, having its inner end positioned in a bore of the body member 44 and its outer end captured in a dimple on the inner face of jaw side plate 12S'. A like spring arrangement 93 is used to bias plate 10S', FIG. 9B.

The state of spring 92 and spring 93, is a state of compression, characterizing the jaw-closed state, but when plunger 25' is advanced to the dash line position, FIG. 9, the springs as 92 and 93 open the jaws. The jaw-open position is limited by the head of stop screw 81 as in the foregoing embodiment, engageable by a jam nut 94 on plate 12S'.

It will be seen from the foregoing that the master jaws are neatly and compactly nested, and accurately guided, being overlapped along a common center line or plane. Stresses during jaw closure are minimized, especially as related to the keeper plates. Compactness is made possible in part by having the cam teeth laterally spaced to accommodate the cam plunger therebetween, the arrangement being such that when the cam teeth and master jaws are spaced apart, moving outwardly of the slot due to cam action, the master jaws concurrently transport or carry the slave jaws to the closed position. This is because the cam tooth is at one side of the slot in which the cam plunger moves, while the related slave jaw is on the opposite side, which is best seen in FIG. 8.

Hence, while preferred embodiments of the invention have been illustrated and described, equivalent configurations, complying with the principle involved, may be adopted.

I claim:

1. A fixture for holding and presenting a workpiece to a tool and comprising a holder member presenting a guideway for a pair of sliding master jaw members, a pair of master jaw members, left and right, slidably mounted in said guideway for movement toward and away from each other, each of said master jaw members adapted respectively to have a slave jaw fitted thereto for clamping a workpiece when the slave jaws are closed and releasing the workpiece when the slave jaws are opened, each master jaw member having a body with a lip extended therefrom in one direction and each lip terminating in a closure cam tooth projecting therefrom normal to said one direction and presenting a jaw closing cam surface, the master jaw members being so mounted in said holder in nested relation that the lips thereof overlap one another in spaced relation with the closure cam teeth extending in opposite directions and laterally spaced from one another thereby to define between them an operating slot for a cam plunger moving back and forth in said slot;

a cam plunger for actuating said master jaw members and mounted within said slot for movement back and forth in a direction normal to the axis of movement of said master jaw members, said cam plunger having a set of opposed cam surfaces engageable complementally with the cam surfaces of said closure cam teeth;

said cam surfaces of the cam plunger being so sloped that when the plunger is moved in one direction to a limit position its cam surfaces wedge and spread the cam surfaces of the closure cam teeth to spread the master jaws outward of said slot while simultaneously closing the slave jaws;

and means to move the master jaws inward of said slot thereby to open the slave jaws when the cam plunger is moved in the opposite direction to a second limit position.

2. A fixture according to claim 1 in which the means to open the slave jaws include:

an opener cam bar on each of the master jaw members and mounted thereon for movement along an axis spaced from but parallel to said master jaw movement, said opening cam bars having jaw opening cam surfaces opposed to one another; and a second set of cam surfaces on the plunger spaced from the first-named set and engageable complementally with the jaw opening cam surfaces of said bars, whereby when the plunger is moved in said opposite direction the second set of cam surfaces of the plunger wedge and force the bars away from each other causing the master jaw members to move inward relative to said slot thereby to open the slave jaws.

3. A fixture according to claim 1 in which the means to open the slave jaws include:

a relief section on the cam plunger which is presented to the cam teeth of the master jaws when the plunger is in its second limit position, allowing said master jaw members to move inward toward one another in a slave jaw opening mode; and springs acting on the master jaws to move the master jaw members inward toward one another when the relief section of the plunger is presented to said cam teeth.

4. A fixture according to claim 2 in which each master jaw is of identical construction with the cam bar and lip thereof in parallel relation and coupled by an intermediate leg member, in which the master jaws are nested in overlapped relation to lie in a common plane with the cam teeth spaced laterally but projecting toward one another, and with the two sets of cam surfaces on the plunger movable in said slot along an axis extending normal to said common plane.

5. A fixture according to claim 3 in which each master jaw is of identical construction with the lips thereof overlapped in a common plane and the teeth thereof lying in said plane and projecting toward one another in laterally spaced relation, the first-named set of cam surfaces on the plunger being movable in said slot along an axis normal to said plane, each jaw member at the end opposite the tooth thereof having a leg parallel to the axis of the plunger, and spring means bearing on said legs to bias the master jaws for movement away from each other.

* * * * *